United States Patent [19]

Dunsworth

[11] Patent Number: 4,522,861

[45] Date of Patent: Jun. 11, 1985

[54] PHOSPHORESCENT TREAD PLATE AND COMPOSITION

[75] Inventor: Charles L. Dunsworth, Midwest City, Okla.

[73] Assignee: Metalines, Inc., Oklahoma City, Okla.

[21] Appl. No.: 524,978

[22] Filed: Aug. 22, 1983

[51] Int. Cl.[3] ..... B32B 23/02

[52] U.S. Cl. ..... 428/192; 523/400

[58] Field of Search ..... 428/192; 523/400

[56] References Cited

U.S. PATENT DOCUMENTS

| | | | |
|---|---|---|---|
| 3,421,274 | 1/1969 | Balzer et al. | 52/179 |
| 4,058,942 | 11/1977 | Naka | 428/163 |

FOREIGN PATENT DOCUMENTS

| | | | |
|---|---|---|---|
| 650269 | 10/1962 | Canada | 523/400 |
| 50-89441 | 7/1975 | Japan | 523/400 |
| 52-15539 | 2/1977 | Japan | 523/400 |
| 53-81529 | 7/1978 | Japan | 523/400 |

*Primary Examiner*—Paul R. Michl
*Assistant Examiner*—N. Sarofin
*Attorney, Agent, or Firm*—Robert Hessin

[57] ABSTRACT

A wear-resistant phosphorescent material consisting of a mixture of a selected ratio of phosphorescent pigment and bleached aluminum oxide as carried by a catalyst-hardened epoxy resin, such phosphorescent material being placeable in selected array on a tread plates or other tread surface.

4 Claims, 3 Drawing Figures

PHOSPHORESCENT TREAD PLATE AND COMPOSITION

BACKGROUND OF THE INVENTION

1. Field of the Invention

The invention relates generally to tread plates and stair nosing structures as used in walkways, stairways and the like and, more particularly, but not by way of limitation, it relates to an improved manufacture of tread plate which utilizes a phosphorescent and highly wear-resistant composition of matter in affixure on the plate. 2. Description of the Prior Art The prior art includes various types of tread plate that are adapted in many ways for affixure to a stair or walkway surface and such prior devices have been constructed from differing materials as dictated primarily by the exigencies of the application. There is a relative paucity of prior teachings that relate to such tread plate materials that also include a substance or attachment for visual aid. U.S. Pat. No. 4,058,942 teaches a flexible tread strip that includes fluorescent layers embedded in the upper surface. This structure is made from a wear-resistant resin such as urethane or polyamide with portions of flexible resin such as vinyl chloride. Fluorescent material strips are then formed of transparent synthetic resin sheet having a so-called fluorescent pigment blended therein. U.S. Pat. No. 3,421,274 is of interest as it is directed to a basic form of stair nosing structure which includes a transverse channel design for receiving a non-slip overlay material such as silicon carbide or aluminum oxide grit embedded or cast in epoxy, resin or the like. This patent includes no visual aid material or structure.

SUMMARY OF THE INVENTION

The present invention relates to improvements in construction of tread plates and stair nosing structures, such improvements being directed to the provision of material which imparts a visual aid character to the structure. The tread plates are formed as a plural channel plate member with each individual channel including wear-resistant tread substance, and having one or more channels of said tread substance composed of a mixture including reflective substance and phosphorescent pigment substance thereby to enable illuminating afterglow of the tread plate.

Therefore, it is an object of the present invention to provide a tread plate that glows in the dark for a prolonged period.

It is also an object of the present invention to provide an improved stair nosing structure that includes illuminated structure during darkened periods.

It is yet further an object of the present invention to provide a tread plate structure capable of exhibiting illumination in various patterns for a considerable time.

Finally, it is an object of the present invention to provide highly wear-resistant tread material that has phosphorescent illuminability for considerable duration.

Other objects and advantages of the invention will be evident from the following detailed description when read in conjunction with the accompanying drawings which illustrate the invention.

DETAILED DESCRIPTION OF THE INVENTION

The present invention provides a phosphorescent substance which can be placed variously and relatively permanently on walkway and stairway surfaces, and which includes phosphor, reflective substance and binder material of highly wear-resistant character. The use of such luminous floor covering has proven to be particularly desirable in stairwells and closed passageways which experience selected hours of darkness, and particularly areas that might be subject to smoke, power failure or the like during emergency situations. Thus, highly wear-resistant material of suitable light color character is mixed with a selected phosphor and a binder or vehicle for adhesion in prescribed surface pattern. In one particular form, the phosphorescent tread material is retained within a tread plate, stair surfacing or the like as will be more particularly described hereinafter.

Figure 1:
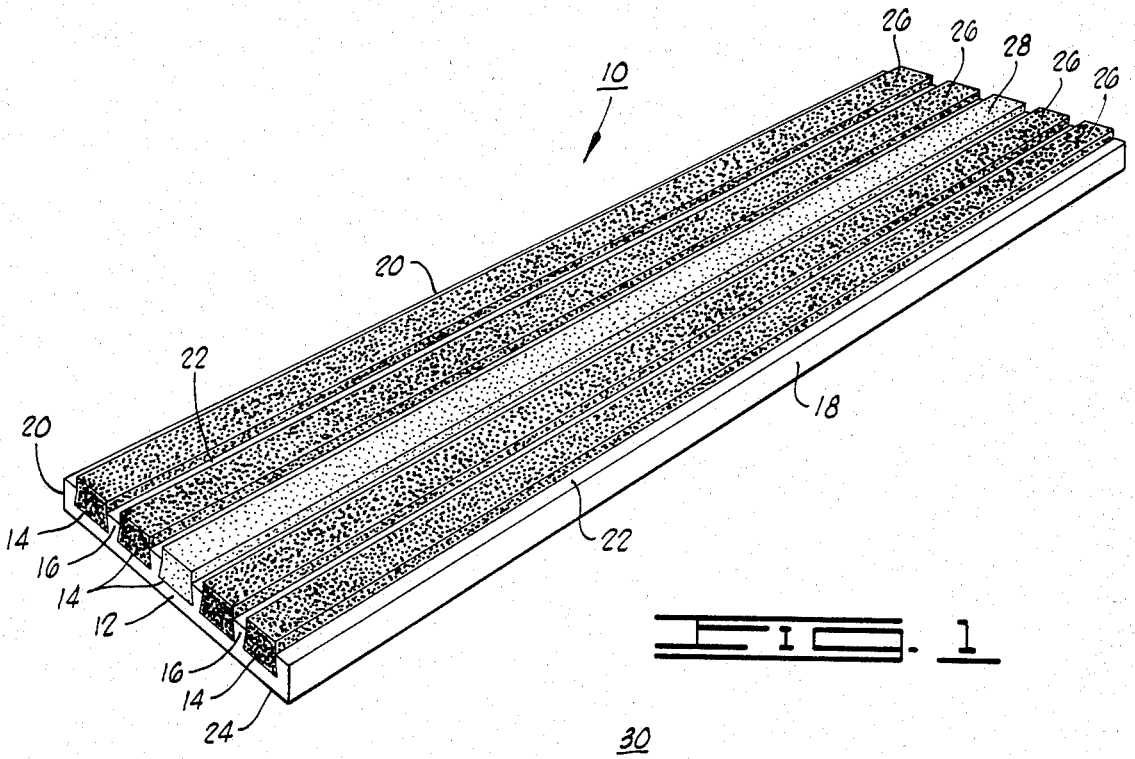
FIG. 1 is a perspective view of a tread plate constructed in accordance with the present invention.

FIG. 1 illustrates a tread plate 10 that consists of a unitarily formed base plate 12 of aluminum or the like. Base plate 12 is extruded to include a plurality of individual channels 14 disposed in parallel therealong. Channels 14 are separated by respective ridges 16, each formed to taper inward defining a greater width across the bottom of each channel 14 than across the top. Opposite sides of tread plate 10 are defined by flanges 18 and 20 which also have slightly tapered inside wall orientation relative to normal to the base of plate 12. Each of ridges 16 and flanges 18 and 20 terminates in an upper surface 22 extending equi-distance above the bottom side 24 of plate 12.

The transverse tread plate channels 14 are then filled with a highly wear-resistant composition in hardening binder for contact with traffic thereacross. Thus, a plurality of channels of tread composition 26 are utilized in combination with a generally lesser number of phosphorescent tread composition 28.

Figure 2:
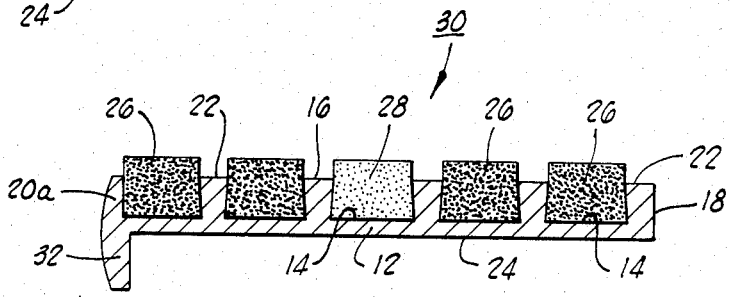
FIG. 2 is a view in cross-section of a stair nosing tread plate as constructed in accordance with the invention.
Figure 3:
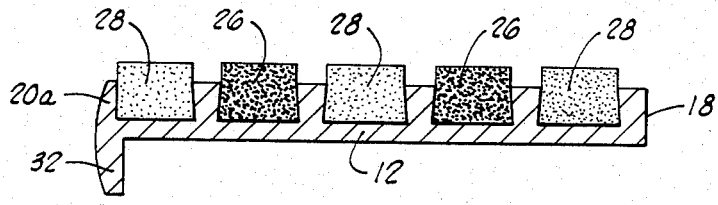
FIG. 3 is a view in cross-section of an alternative design of the present invention.

FIG. 2 illustrates a stair nose plate 30 that is similar to the tread plate 10 except that the base plate 12 further includes a forward nose flange 20*a* having a lower lip 32 for positioning on the forward portion of a stair step. Any of the tread plates 10 or nose plates 30 may be secured variously on their supporting surfaces. Thus, tread plate 10 may be screw fastened on the surface of a walkway or it may be bonded in recessed disposition either continuously or in spaced relationship therealong. Likewise, the toe plates 30 may also be utilized in various modes of affixure. As shown in FIG. 3, it may be desirable to use greater percent coverage of phosphorescent tread composition 28 than tread composition 26 and this may be varied as desired. Testing has shown that phosphorescent tread composition 28 exhibits extremely good wearability characteristics relative to the tread composition 26.

The tread composition 26 is made up of 6 parts aluminum oxide ($Al_2O_3$) plus one part silicon carbide (SiC), plus a minimal part of carbon black. This composition is then mixed with a selected epoxy resin and catalyst and the mixture is deposited by pressure ram in the respective plate channels or other base surface. Curing under heat then provides secure adherence of the tread composition to its support member.

The phosphorescent tread composition is formed as a mixture of two parts phosphor, eight parts bleached aluminum oxide ($Al_2O_3$) plus a small amount of silicon carbide (SiC). The use of a minimum amount of silicon carbide reduces the black level and avoids absorption of light. The aluminum oxide is bleached by acid washing and is commercially available in that form. The measured amounts of phosphor, bleached aluminum oxide and silicon carbide are blended together and mixed with a selected epoxy resin, and the composition 28 is then deposited in place with a suitable catalyst to form the tread plate structure.

A suitable epoxy resin EPON Resin 8132 is commercially available from Shell Chemical Company and it may be used with any of several catalysts, Viz. Type DETA as commercially available from Dow Chemical Corporation, Type 1638 as commercially available from Pacific Anchor Chemical Corporation of Los Angeles, Calif., or Type 507 as is also commercially available from Pacific Anchor Chemical Corporation. The Type 507 finds particular application for use in salt water resistent installations and adheres to certain standards and specifications set forth by governmental and regulatory bodies.

After deposition of either the tread or phosphorescent compositions 26 or 28, it is necessary to cure the epoxy to provide a rugged and reliable final plate structure. The particular type of epoxy resin and catalyst as set forth above are effectively cured by the application of heat at 240° F. for a period of approximately thirty minutes. In manufacture, the plates are completed in a continuous process as the channeled base plate extrusion is fed through a machine that includes a plurality of dies, one per channel, which effect pressure ram deposition of composition, either phosphorescent or tread, into the individual channels continuously; and, the tread plates are then subjected in batches of selected length to heat curing.

The phosphor utilized is a phosphorescent pigment known commercially as Grade 6SSU which is available from United Mineral and Chemical Corporation of New York, N.Y. The chemical composition of the phosphor is a mixture of zinc sulphide and copper having particle size of approximately 20 microns. The material has a light accumulation saturation point for maximum brightness of four minutes and it has a rated afterglow in total darkness of approximately 18 hours. The phosphorescence pigment emmission peak wave length is in the green range at 522 nanometers with excitation being effected at 365 nanometers.

The phosphorescent composition as set forth above can be varied within reasonable ranges of concentration to adjust values of hardness, light emanation and the like in specific manner. It is also contemplated that the phosphorescent composition be arrayed in a variety of base members other than the specific tread plate design of FIG. 1, e.g. it may be utilized on signs and the like for various notice and direction uses. The phosphorescent composition is also capable of being applied directly to an existing surface with subsequent cure conditioning.

Changes may be made in combination and arrangement of elements as herefore set forth in the specification and shown in the drawing; it being understood that changes may be made in the embodiments disclosed without departing from the spirit and scope of the invention as defined in the following claims.

What is claimed is:

1. A phosphorescent, highly wear resistant composition comprising:

a mixture of approximtely one part zinc sulfide mixed with copper phosphorescent pigment, four parts bleached aluminum oxide, and a minimal amount of silicon carbide placed in deposition in combination with an epoxy resin hardened by a catalyst.

2. A phosphorescent composition as set forth in claim 1 wherein:

catalyst is selected for the quality of salt water resistivity.

3. A tread plate for disposition in a walkway, comprising:

a baseplate unitarily formed with the upper surface defining a plurality of parallel channels separated by respective ridge members;

at least one of said channels receiving deposition of a phosphorescent wear-resistant tread material consisting of a mixture of approximately one part phosphorescent material formed of zinc sulfide mixed with copper, four parts bleached aluminum oxide, and a minimal amount of silicon carbide, in disbursement in a binder catalyst hardened epoxy resin; and remaining ones of said channels receiving deposition of wear-resistant tread material.

4. A tread plate as set forth in claim 3 wherein:

said base plate is a rectangular stair nosing structure having a nose flange extending below one edge.

* * * * *